US005657691A

United States Patent [19]

Kato

[11] Patent Number: 5,657,691

[45] Date of Patent: Aug. 19, 1997

[54] INK SUPPLY DEVICE FOR PRINTING APPARATUS

[75] Inventor: Hiroyasu Kato, Tokyo, Japan

[73] Assignee: Riso Kagaku Corporation, Tokyo, Japan

[21] Appl. No.: 558,870

[22] Filed: Nov. 16, 1995

[30] Foreign Application Priority Data

Nov. 18, 1994 [JP] Japan ..... 6-285160

[51] Int. Cl.[6] ..... B41F 15/40; B41F 31/06

[52] U.S. Cl. ..... 101/120

[58] Field of Search ..... 101/348, 349, 101/350, 363, 364, 365, 366, 351, 352, 148, 120, 121, 119

[56] References Cited

U.S. PATENT DOCUMENTS

| | | | |
|---|---|---|---|
| 2,996,981 | 8/1961 | Reinartz et al. | 101/148 |
| 3,796,153 | 3/1974 | Jaffa | 101/120 |
| 4,385,558 | 5/1983 | Takahashi et al. | 101/120 |
| 4,408,527 | 10/1983 | Bell | 101/350 |

*Primary Examiner*—J. Reed Fisher

*Attorney, Agent, or Firm*—Sughrue, Mion, Zinn, Macpeak & Seas

[57] ABSTRACT

An ink supply device for a printing apparatus, the ink supply device being positioned within a porous cylindrical drum and including: a frame body having side plates confronting each other; an ink supply roller supported between the side plates by the frame body, a lower portion of the ink supply roller coming in contact with an inner circumferential surface of the cylindrical drum, and the ink supply roller being rotatable about a central axis thereof and in synchronism with the rotation of the cylindrical drum; an ink amount control member supported between the plates by the frame body, and having a predetermined gap with respect to an outer circumferential surface of the ink supply roller while extending along one generatrix of the ink supply roller, wherein the ink amount control member, the ink supply roller and the side plates cooperate to form a space in which ink is pooled; a rodlike member supported between the side plates by the frame body and extending within the space where ink is pooled along the generatrix of the ink supply roller; an ink distributor supported by the frame body and positioned above the ink supply roller; and grooves arranged on the ink amount control member, for spreading ink in the space where ink is pooled along the generatrix of the ink supply roller while the ink supply roller is being rotated.

10 Claims, 3 Drawing Sheets

INK SUPPLY DEVICE FOR PRINTING APPARATUS

BACKGROUND OF THE INVENTION

1. Field of the Invention

The invention relates to ink supply devices for printing apparatuses and, more particularly, to an ink supply device for supplying an ink layer over the outer circumferential surface of a rollerlike ink supply means.

2. Description of the Related Art

As shown in FIG. 3, a known ink supply means for printing apparatuses includes: a squeegee roller 101 supported by a shaft between side plates that confront each other so as to be rotatable about the central axis of the shaft thereof; a distributor 102, arranged above the squeegee roller 101, for supplying ink over the outer circumferential surface of the squeegee roller 101; and a doctor roller 103, arranged next to the squeegee roller 101 while interposing a predetermined distance therebetween, for controlling the thickness of an ink layer formed over the outer circumferential surface of the squeegee roller 101. The distributor 102 is arranged above the squeegee roller 101, senses the amount of ink in an ink pool 104 through an ink amount sensing needle 105*a* of an ink sensor 105, and supplies the ink in response to a signal indicating excess or deficiency of the ink. It may be noted that the distributor 102 can be formed into various shapes. For example, a distributor 102 having a plurality of small-diameter holes formed in a tubular member running in parallel with the squeegee roller 101, or a distributor 102 having a plurality of nozzles may be applicable.

The ink supply device thus constructed has the ink pool 104 that is arranged in cooperation with a part of the squeegee roller 101, a part of the doctor roller 103, and the side plates through which the squeegee roller 101 is journaled. A vortex that fluidly rotates about an axis running substantially in parallel with the squeegee roller 101 when the squeegee roller 101 starts to rotate is produced in the ink pool 104. While the squeegee roller 101 is rotating, the ink in the ink pool 104 is applied over the outer circumferential surface of the squeegee roller 101 through a small gap between the squeegee roller 101 and the doctor roller 103 to thereby allow the ink to be transferred onto the inner circumferential surface of a plate cylinder that takes the form of a circular cylinder, printing paper, and the like.

When large quantities of ink are consumed because it is immediately after the ink has been supplied from the distributor 102 or when large quantities of ink are consumed locally because an image to be printed has dark portions localized, a ink lump portion M is produced on the outer circumferential surface of the squeegee roller 101 or on the ink pool 104 as shown in FIG. 3. If such ink lump portion is immediately spread uniformly along the length of the squeegee roller 101, there is no problem. However, the viscosity of the ink used for this type of ink supply device is comparatively high and it, therefore, takes some time before the ink is spread out.

In addition, the aforementioned conventional ink supply device is not designed to vary the rotational speed of the squeegee roller 101 even if the ink has been supplied. Therefore, the ink lump portion M directly affects the printing, causing an irregularly printed image and the like, as a result of the ink lump portion M having been transferred onto the inner circumferential surface 106 of the cylindrical drum. Further, when the ink amount sensing needle 105*a* comes in contact with the ink lump portion M under the condition that the amount of ink is deficient in terms of the entire part of the ink pool 104, the ink amount sensor judges that the amount of ink is sufficient to stop the supply of ink, causing shortage of ink. In addition, if the ink amount sensing needle 105*a* and an overflow sensing needle 105*b* are positioned at a portion other than which is the ink lump portion M in the ink pool 104, and in which the amount of ink is small, the sensor judges that the amount of ink is deficient and thereby continues the supply of ink. As a result, the size of the ink lump portion M is increased, bringing about an overflow of ink.

SUMMARY OF THE INVENTION

The invention has been made in view of the aforementioned circumstances. The object of the invention is, therefore, to provide an ink supply device for printing apparatuses capable of spreading out uniformly an ink layer that is supplied to a rollerlike ink supply means.

To achieve the above object, a first aspect of the invention is applied to an ink supply device for a printing apparatus, the ink supply device being positioned within a porous cylindrical drum and including: a frame body having side plates confronting each other; an ink supply roller supported between the side plates by the frame body, a lower portion of the ink supply roller coming in contact with an inner circumferential surface of the cylindrical drum, and the ink supply roller being rotatable about a central axis thereof and in synchronism with the rotation of the cylindrical drum; an ink amount control member supported between the plates by the frame body, and having a predetermined gap with respect to an outer circumferential surface of the ink supply roller while extending along one generatrix of the ink supply roller, wherein the ink amount control member, the ink supply roller and the side plates cooperate to form a space in which ink is pooled; a rodlike member supported between the side plates by the frame body and extending within the space where ink is pooled along the generatrix of the ink supply roller; an ink distributor supported by the frame body and positioned above the ink supply roller; and ink spread means, being arranged on the ink amount control member, for spreading ink in the space where ink is pooled along the generatrix of the ink supply roller while the ink supply roller is being rotated.

The ink spread means includes grooves arranged on the side of a surface of the ink amount control member, the surface forming the ink pool, each of the grooves extending upward from the side of the gap and being sloped toward an end of the ink amount control member.

The ink supply device for printing apparatuses may include a rodlike member that extends within the ink pool along a generatrix of the ink supply roller.

The ink supply device for printing apparatuses may also include an ink supplying outlet being disposed above the ink supply roller so that the ink can be supplied to the ink supply roller.

When the ink is supplied from the ink supplying outlet of the distributor to the ink pool, a vortex is produced to the ink by the rotation of the ink supply roller and the rodlike member. As a result, the ink tends to spread out along the length of the ink supply roller. At this instance, the projections and recesses formed by the grooves arranged in the ink amount control member cause shearing stress to act in the tangential direction with respect to the surface of the ink amount control member which is in contact with the ink pool. The shearing stress thus caused contributes to increasing the shearing stress on the vortex of the ink, so that the ink becomes more fluid. The ink whose fluidity has been increased is spread out while introduced in such a direction as to decrease the contact area thereof with the ink amount control member, i.e., toward the ends of the ink amount control member from the projections and recesses of the grooves, together with the vortex. Hence, the ink pool twines around the rodlike member uniformly to thereby make the thickness of the ink pool uniform along the length of the ink supply roller.

DETAILED DESCRIPTION OF THE PREFERRED EMBODIMENTS

Figure 1:
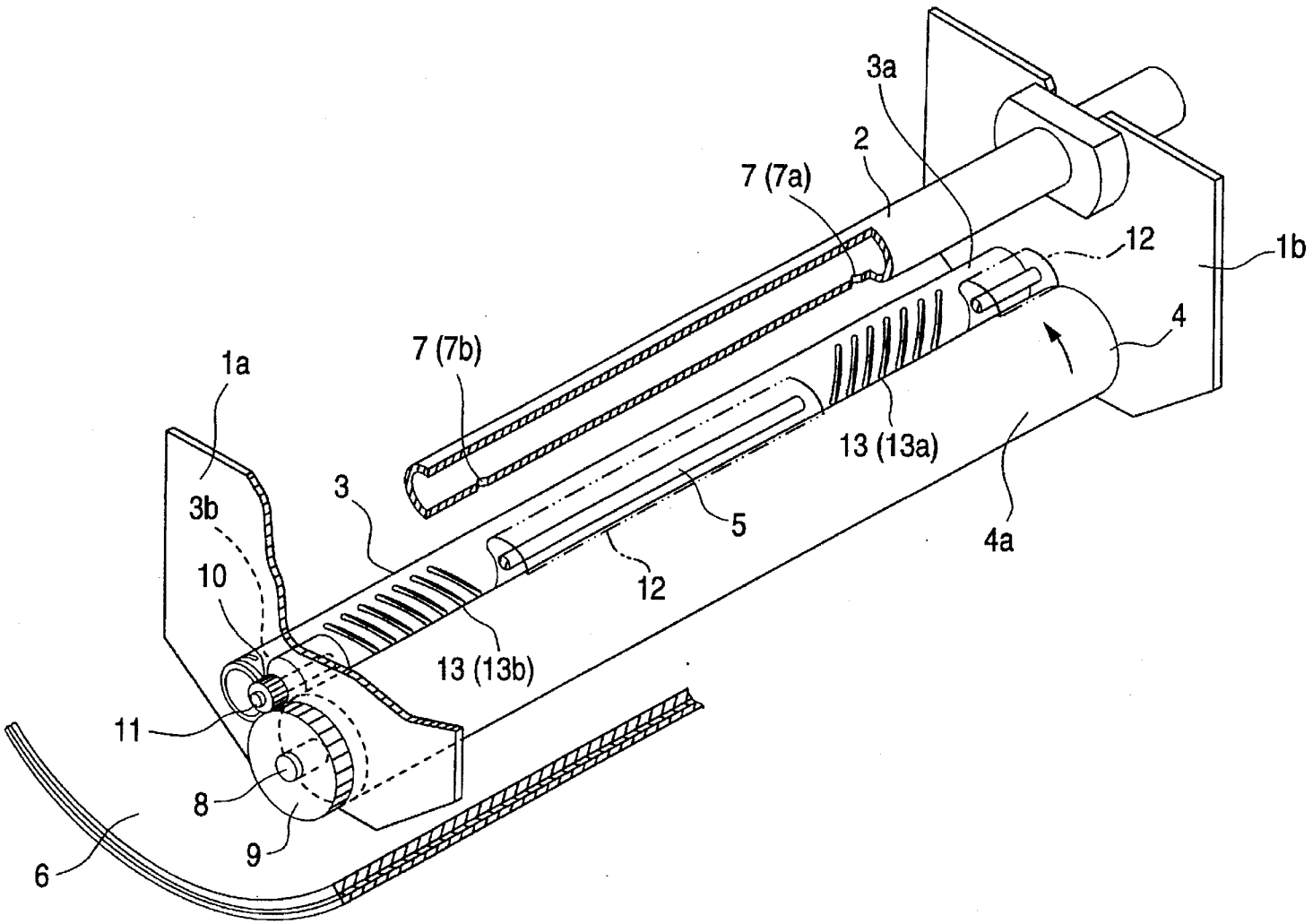
FIG. 1 is a perspective view showing an ink supply device for printing apparatuses, which is an embodiment of the invention.
Figure 2:
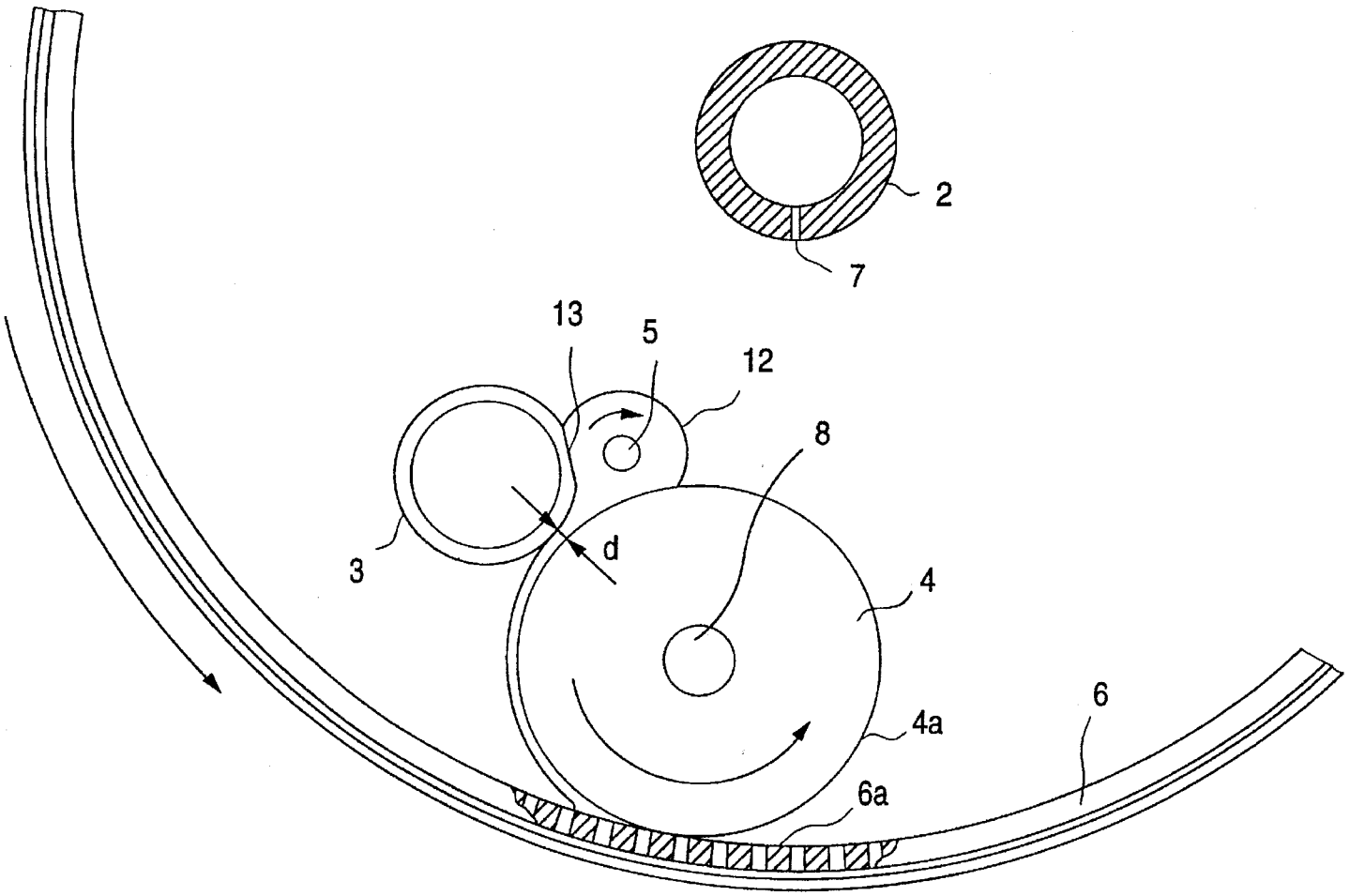
FIG. 2 is a sectional view of the ink supply device.
Figure 3:
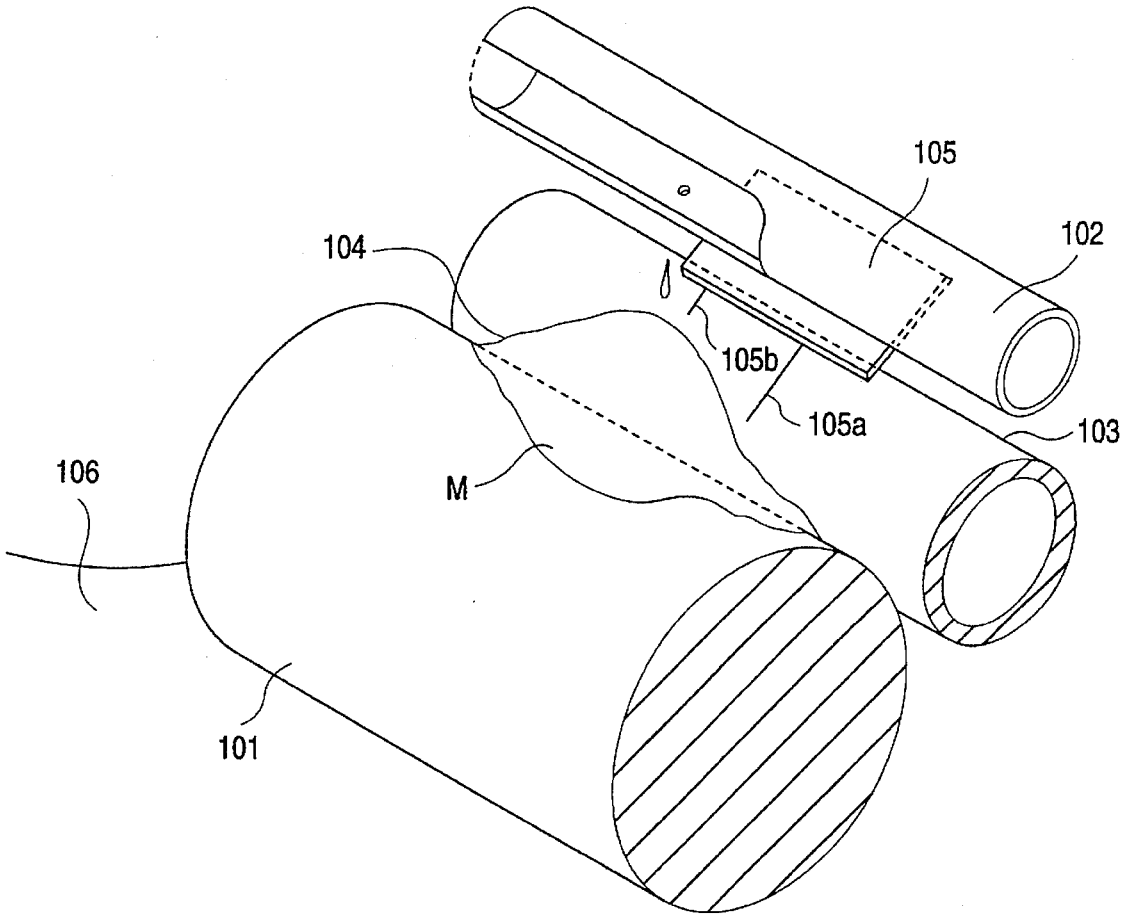
FIG. 3 PRIOR ART
FIG. 3 is a diagram showing an exemplary conventional ink supply device with a part thereof omitted.

FIG. 1 is a perspective view showing an ink supply device for a printing apparatus, which is an embodiment of the invention; and FIG. 2 is a sectional view of the ink supply device.

In FIG. 1, side plates 1*a*, 1*b* are fixed to a machine frame or the like of a printing apparatus not shown. A distributor 2 and a doctor roller 3 are secured to both these side plates 1*a*, 1*b*, and a squeegee roller 4 and a rodlike member 5 are rotatably supported by these plates 1*a*, 1*b*.

While the distributor 2 and the rodlike member 5 are shown only partially for convenience in FIG. 1, these members 2, 5 are actually arranged so as to extend linearly between the side plates 1*a*, 1*b*.

The distributor 2 is made of a hollow tubular member. As shown in FIG. 2, the distributor 2 is positioned substantially at the center of a porous cylindrical drum 6 that takes the form of a circular cylinder. A plurality of small-diameter holes 7 are formed so as to pass through a downward outer circumferential surface of the distributor 2. In FIG. 1, small-diameters 7*a*, 7*b* are formed at two positions at a predetermined interval. The distributor 2 is filled with printing ink. The ink is supplied from an ink depositing means (not shown) through an ink pump (not shown) in accordance with an ink excess or deficient signal. The distributor 2 supplies the squeegee roller 4 with a predetermined amount of ink from a remote position through the small-diameter holes 7*a*, 7*b*.

The squeegee roller 4 is a 40 mm diameter rodlike roller made of aluminum in this embodiment. As shown in FIG. 2, the squeegee roller 4 is arranged below the distributor 2 with an outer circumferential surface 4*a* thereof that is on the lower side as viewed in the vertical direction coming in contact with an inner circumferential surface 6*a* of the plate cylinder 6. As shown in FIG. 1, the squeegee roller 4 has the end thereof on the side plate 1*b* side coupled to driving means (not shown), so that the squeegee roller 4 can rotate about a shaft 8 in a direction indicated by the arrow in synchronism with the rotation of the plate cylinder 6. A large-diameter gear 9 is attached to the other end of the squeegee roller 4 on the side plate 1*a* side. The rotation of the large-diameter gear 9 is interlocked with that of the squeegee roller 4.

The large-diameter gear 9 is meshed with a small-diameter gear 10. The small-diameter 10 is mounted on a shaft 11 that is on the side plate 1*a* side of the rodlike member 5. The rodlike member 5 is, e.g., a 4 mm diameter iron rod. When the squeegee roller 4 rotates about the shaft 8, the rodlike member 5 rotates in a direction opposite to the direction in which the squeegee roller 4 rotates with the small-diameter gear 10 rotating about the shaft 11 through the large-diameter gear 9.

The doctor roller 3 is formed into, e.g., a 20 mm diameter cylindrical body made of stainless steel. A predetermined distance d is interposed between the outer circumferential surface of the doctor roller 3 and the outer circumferential surface of the squeegee roller 4. The doctor roller 3 runs in parallel with the squeegee roller 4. The distance d is appropriately selected in accordance with the viscosity of the ink. In this embodiment, the distance d is set to about 0.08 mm for an ink whose dynamic viscosity by the rotation of the squeegee roller 4 is 0.5 Pa.s at 23° C.

A region surrounded by the side plates 1*a*, 1*b*, the doctor roller 3, and the squeegee roller 4 forms an ink pool 12 in which the ink dropping through the small-diameter holes 7 of the distributor 2 is pooled. Excess and deficiency in the amount of ink in this ink pool 12 are detected by ink amount sensing means (not shown). As shown in FIG. 2, a vortex is produced in the ink pool 12 by the rotation of the squeegee roller 4 and the rodlike member 5. The rotational ratio between the squeegee roller 4 and the rodlike member 5 is, e.g., 1:2.5 in this embodiment. The squeegee roller 4 rotates at a speed of 180 rpm (rotation per minute) during medium speed printing in this embodiment.

A plurality of groove sections 13 are arranged on an ink pool 12 side outer circumferential surface of the doctor roller 3. Each groove section 13 includes a plurality of grooves arrayed at an equal interval in the axial direction of the doctor roll 3 and extends from a position close to the position immediately below each of the two small-diameter holes 7 of the distributor 2 toward each of end portions 3*a*, 3*b* of the doctor roller 3. Each groove 13 depicts a slope extending upward from the gap d side toward the end portion 3*a* or 3*b*. More specifically, each groove 13 extends at a sloping angle of 45° with respect to the axis from one end on the squeegee roller 4 side to the other end on the end portion 3*a* or 3*b* side of the doctor roller 3. In FIG. 1, a groove section 13*a* extending from the small-diameter hole 7*a* side and a groove section 13*b* extending from the small-diameter hole 7*b* side are sloped 45° with respect to the axis oppositely from each other. The length of each groove 13 is selected so as to be at least longer than the length of the surface on which the doctor roller 3 comes in contact with the ink pool 12 as viewed in the circumferential direction of the doctor roller 3.

It may be noted that the sloping angle of the groove 13 can be selected appropriately in consideration of the properties of the ink such as viscosity. It may also be noted that the depth of the groove 13 can be selected appropriately as well.

The doctor roller 3, the squeegee roller 4, and rodlike member 5 may be made of any material as long as the surfaces of these members made of such material are resistant to the solvent and the like contained in the ink. To form an ideal vortex, however, it is preferred that a material of which the rodlike member 5 is made have a certain hardness.

In the thus constructed ink supply device, when the ink has been consumed to make the ink pool 12 deficient in ink, a signal from the ink amount sensing means causes the ink to be supplied to the ink pool from the ink depositing means through the ink pump and the distributor 2. When the distributor 2 is fully loaded with the ink, the ink is jetted out of the small-diameter holes 7*a*, 7*b* by pressure applied by the ink pump. The ink jetted drops onto the surface of the squeegee roller 4 immediately below the distributor 2 and thereafter forms the ink pool 12 in which the ink is deposited in lump form.

Since a vortex is produced to the lump of ink by the rotation of the squeegee roller 4 and the rodlike member 5, the projections and recesses formed by the groove sections 13 in the doctor roller 3 cause shearing stress to act in the tangential direction with respect to the outer circumferential surface of the doctor roller 3 that is in contact with the ink pool 12. As a result, the fluidity of the ink is increased with increasing shearing stress on the vortex. The lump of ink becomes easy to move with increased fluidity in this way and is gradually spread out toward the end portions 3*a* and 3*b* of the doctor roller 3 along the slopes of the respective groove sections 13 from the positions of the doctor roller 3 close to the positions immediately below the small-diameter holes 7*a*, 7*b*. Simultaneously therewith, the lump of ink gradually dwindles. Hence, the ink pool 12 comes to have a uniform thickness over the entire surface of the doctor roller 3 and the squeegee roller 4 in the axial direction in such a manner as to allow the ink pool 12 to twine around the rodlike member 5.

While the example in which each groove section 13 has the grooves arrayed at an equal interval on the outer circumferential surface of the doctor roller 3 as has been described in the aforementioned embodiment, it should be understood that the ink tends to move toward where higher pressure is applied. Thus, if the groove sections 13 are arranged so that the grooves 13 are arrayed at such an interval as to become shorter with increasing distance from the positions immediately below the small-diameter holes 7 of the distributor 2, the thickness of the ink pool 12 can be made uniform more quickly. Further, it may be noted that the number of small-diameter holes 7 can be selected appropriately as long as the small-diameter holes 7 can jet the ink out of the distributor 2 uniformly.

While the rotatable rodlike member 5 is arranged within the ink pool 12 in the aforementioned embodiment, similar advantages can be obtained by rotating the doctor roller 3. It may be noted that the groove sections 13 can be arranged over the entire circumference of the doctor roller 3 in the case which the doctor roller 3 is rotated.

Further, while the example in which the lump of ink is being spread out on the doctor roller 3 from the positions of the doctor roller 3 which are close to the positions immediately below the small-diameter holes 7*a*, 7*b* toward both ends of the doctor roller 3 as in the aforementioned embodiment, the groove sections 13 may also be arranged so as to extend toward the middle of the doctor roller 3 irrespective of the number of small-diameter holes 7.

Still further, the doctor roller 3 may have projected portions, a roughened surface, and the like, other than the groove sections 13 within such a range so as to keep a distance with respect to the squeegee roller 4, as long as the shape of the doctor roller 3 meets the requirements that a force be exerted in the tangential direction with respect to a surface on which the vortex of the ink acts, i.e., to a surface on which the outer circumferential surface of the doctor roller 3 comes in contact with the ink pool 12 and that the ink can be spread out in the axial direction of the doctor roller 3.

While the doctor roller 3 is employed as a means for controlling the amount of ink on the surface of the squeegee roller 4 in the aforementioned embodiment, the doctor roller 3 may not necessarily be rollerlike in shape but may be bladelike.

Using the ink supply device for printing apparatuses of the invention, the ink can be spread out uniformly along the generatrix of the roller without causing the ink layer supplied on the rollerlike ink supply means to be locally concentrated or sparsely distributed.

According to the ink supply device recited as the second aspect of the invention in particular, a shearing stress is exerted in the tangential direction with respect to the surface of the ink amount control member that comes in contact with the ink pool by the projections and recesses formed by the grooves to thereby increase the shearing stress on the vortex of the ink. Therefore, the ink can be spread uniformly over the entire region in the direction of the generatrix of the roller at all times.

Further, according to the ink supply device recited as the third aspect of the invention, the rodlike member rotates in synchronism with the ink supply roller oppositely from each other. Therefore, a vortex is imparted to the ink in the ink pool to thereby allow the ink to be spread over the entire region in the direction of the generatrix of the roller.

What is claimed is:

1. An ink supply device for a printing apparatus, said ink supply device being positioned within a porous cylindrical drum, said ink supply device comprising:

a frame body having side plates confronting each other;

an ink supply roller supported between said side plates by said frame body, a lower portion of said ink supply roller coming in contact with an inner circumferential surface of the cylindrical drum, and said ink supply roller being rotatable about a central axis thereof;

an ink distributor supported by said frame body and positioned above said ink supply roller;

an ink amount control member supported between said plates by said frame body, said ink amount control member having a predetermined gap with respect to an outer circumferential surface of said ink supply roller while extending along one generatrix of said ink supply roller, and wherein said ink amount control member, said ink supply roller and said side plates cooperate to form a space in which ink is pooled;

a rotatable rodlike member supported between said side plates by said frame body and arranged within the ink pool; and ink spread means, being arranged on said ink amount control member, for spreading ink in said space where ink is pooled along the generatrix of said ink supply roller while said ink supply roller is being rotated.

2. An ink supply device according to claim 1, wherein said ink spread means comprises:

grooves arranged on a surface of said ink amount control member, the surface forming the space where ink is pooled, each of said grooves extending upward from the side of the gap and being sloped toward an end of said ink amount control member.

3. An ink supply device according to claim 1, wherein said rodlike member extends within said space where ink is pooled along the generatrix of said ink supply roller and is rotatable in a direction opposite to a direction in which said ink supply roller rotates.

4. An ink supply device according to claim 3, wherein said ink supply roller has a gear at the outside of one of said side plates, and said rodlike member has a gear engaging with said gear of said ink supply roller.

5. An ink supply device according to claim 1, further comprising:

an ink supplying outlet disposed on a lower outer circumferential surface of said ink distributor above said ink supply roller, for supplying ink to said ink supply roller.

6. An ink supply device according to claim 5, wherein said ink spread means comprises:

grooves arranged at least near a position immediately below said ink supplying outlet on a surface of said ink amount control member, the surface which forms said space where ink is pooled, each of said grooves extending upward from the side of the gap and being sloped toward an end of said ink amount control member.

7. An ink supply device according to claim 6, wherein said grooves are arrayed at an equal interval.

8. An ink supply device according to claim 6, wherein said grooves are arrayed at an interval that becomes shorter with increasing distance from the position immediately below said ink supplying outlet.

9. An ink supply device for a printing apparatus, comprising:

a frame body having side plates confronting each other;

an ink supply roller supported between said side plates by said frame body, said ink supply roller being rotatable about a central axis thereof;

an ink amount control member supported between said plates by said frame body, said ink amount control member having a predetermined gap with respect to an outer circumferential surface of said ink supply roller while extending along one generatrix of said ink supply roller;

an ink pool arranged in cooperation with a part of said ink supply roller, a part of said ink amount control member, and said side plates;

a rodlike member supported between said side plates by said frame body, said rodlike member extending within said ink pool along the generatrix of said ink supply roller and being rotatable in a direction opposite to a direction in which said ink supply roller rotates; and ink spread means, being arranged on said ink amount control member, for spreading ink in said ink pool along the generatrix of said ink supply roller while said ink supply roller is being rotated.

10. An ink supply device according to claim 9, wherein said ink supply roller has a gear at the outside of one of said side plates, and said rodlike member has a gear engaging with said gear of said ink supply roller.

* * * * *